United States Patent [19]

Davies et al.

[11] 4,208,082

[45] Jun. 17, 1980

[54] QUICK-RELEASE ELECTRICAL CONNECTORS

[75] Inventors: Andrew Davies; Derek Taylor, both of Whitstable, England

[73] Assignee: Bunker Ramo Corporation, Oak Brook, Ill.

[21] Appl. No.: 904,152

[22] Filed: May 9, 1978

[30] Foreign Application Priority Data

May 9, 1977 [GB] United Kingdom ..... 19389/77

[51] Int. Cl.[2] ..... H01R 13/62

[52] U.S. Cl. ..... 339/45 M; 339/DIG. 2

[58] Field of Search ..... 339/45, DIG. 2, 89, 339/90

[56] References Cited

U.S. PATENT DOCUMENTS

| | | | |
|---|---|---|---|
| 2,890,434 | 6/1959 | Ray et al. | 339/DIG. 2 |
| 3,156,512 | 11/1964 | Peterson et al. | 339/45 M |
| 3,452,316 | 6/1969 | Panek et al. | 339/45 M |
| 3,601,764 | 8/1971 | Cameron | 339/DIG. 2 |

*Primary Examiner*—Joseph H. McGlynn

*Attorney, Agent, or Firm*—F. M. Arbuckle; J. R. Hoffman

[57] ABSTRACT

A quick-release electrical connector having a coupling member captive on and rotatable about a body of the connector, the member including circumferentially-spaced, forwardly-projecting tangs of polymeric material constituting a gapped barrel and having an internal screwthread thereon for engagement with an external screwthread of a mating connector. The tangs are resilient and allow rapid disconnection of the connectors upon application of an axial force sufficient to cause interaction of the internal and external screwthreads and expansion of the barrel to allow the internal screwthreads to ride over the external screwthreads. An inhibitor device is provided to selectively inhibit expansion of the barrel and separation of the connectors.

5 Claims, 4 Drawing Figures

QUICK-RELEASE ELECTRICAL CONNECTORS

BACKGROUND OF THE INVENTION

1. Field of the Invention

The present invention relates to the field of electrical connectors, and more particularly to the field of quick-release electrical connectors.

2. Description of the Prior Art

Quick-release electrical connectors are employed, for example, to make electrical connections between missile launch equipment and a ballastic missile up until launching. For such purposes, it is important that the connector should possess "fail-safe" characteristics. Bayonet-coupled connectors have been found to be unsuitable in that their quick-release mechanism will usually only function properly if the two parts of the connector have been fully coupled together. On the other hand, screw-coupled connectors are not prone to this failing, and furthermore, they have the advantage that it is easier to apply a high mating force to couple the two parts fully together.

Examples of screw-coupled quick-release electrical connectors are to be found in U.S. Pat. No. 3,452,316. This specification describes connectors which have on one part a rotatable coupling ring with tangs which normally, in their relaxed state, diverge from one another. A retaining sleeve is provided in conjunction with the tangs to deflect them radially inwards to a position where they extend generally parallel to the axis of the connector. The tangs are internally screwthreaded and, when deflected radially inwards by the sleeve, can engage with a complementary external screw-thread on the other part of the connector to enable coupling of the two parts. A lanyard release ring or similar means is provided to enable the sleeve to be withdrawn from its tang-deflecting position. When the sleeve is thereby withdrawn the tangs spring radially outwards and are no longer held in engagement with the said external screwthread. Rapid uncoupling of the two parts by application of an axial quick-release force can then take place.

With the quick-release connectors of this earlier U.S. Patent, the tangs of the coupling ring assume whenever possible a position in which they no longer secure the two parts of the connector together. The retaining sleeve is essential for deflecting the tangs radially inwards to a position where they can engage the external screwthread of the other part of the connector. Thus, unintentional withdrawal of the sleeve, or any other functional failure thereof, inevitably leads to disengagement of the tangs whereby premature uncoupling of the connector can occur.

SUMMARY OF THE INVENTION

It is therefore an object of the present invention to provide an electrical connector in which unintentional uncoupling of the connector is avoided, even if the sleeve is unintentionally withdrawn.

In accordance with the present invention there is provided a quick-release electrical connector having a coupling member which is captive on, and rotatable about the axis of, the body of the connector and has circumferentially-spaced, forwardly-projecting tangs of resilient polymeric material constituting a gapped barrel on which an internal gapped screwthread is formed for engagement with an external screwthread on a complementary mating connector and permitting rapid separation of the two parts by application of an axial quick-release force sufficient to cause such interaction of the internal and external screwthreads that the barrel expands by enforced radial outward deflection of the resilient tangs and the internal screwthread rides axially over the external screwthread to effect the separation of the two connectors, and an inhibitor ring axially movable between a first position in which it inhibits the said expansion and a second position in which it permits the said expansion.

Thus the tangs of the coupling member employed are not biased to a disengaged position. They will normally remain in screw engagement with the external screwthread of the complementary second part of the connector irrespective of the position of the inhibitor ring, whereby the connector is at least to some extent "fail-safe". Moreover, screw coupling and uncoupling can take place whether or not the inhibitor means is in its inhibit position. The inhibitor means preferably comprise an inhibitor ring.

Connectors embodying the present invention still have quick-release capability in that moving the inhibitor means to its second position permits the barrel to expand when needed and permits the internal screwthread of the tangs to ride axially over the external screwthread of the complementary connector. Since it is necessary to apply sufficient axial force before the threads will interact to bring about the barrel expansion and the riding over action, there is less risk of accidental uncoupling of the two connectors. An additional advantage of connectors embodying the present invention is that as the tangs are of polymeric material, any swarf-like cuttings generated from the tangs by the interaction of the screwthreads will not be electrically conductive. Thus the risk of short circuits at the instant of quick-release is reduced. Additionally, and also because of their polymeric nature, the tangs will possess lubricating properties facilitating the riding of the internal thread over the external thread upon application of the quick-release force.

Preferred polymeric materials for the tangs include polyvinyl acetals and polysulphones. These two polymers offer good mechanical properties together with thermal stability. Ordinarily, the coupling member as a whole, and not just the tangs forming the gapped barrel, will be made of the polymeric material. The manufacture of such coupling members is relatively easy, particularly when compared to the steps needed to make coupling rings with divergent, screwthreaded, tangs for the connectors of the U.S. Patent referred to previously. A hollow cylinder of the selected polymer can be tapped for part of its length to form an internal screwthread therein. Longitudinal shots can then be cut in the cylinder from one end to leave the tangs which constitute the gapped barrel. The screwthread of the gapped barrel preferably has a rounded V-shaped profile. This or other profiles wherein the screwthread has a sloping flank on its trailing side facilitate the required interaction between the internal screwthread of the gapped barrel and the external thread of the complementary connector.

The inhibitor means and coupling member will usually be housed within an outer grooved sleeve, and the inhibitor ring will usually inhibit the expansion of the barrel by engagement with an outer gapped circular rib provided on the barrel. Preferably the inhibitor means is biased to its inhibiting position, for example by a wave spring housed behind the inhibitor means. It is then preferred to provide means for withdrawing the inhibitor means against the action of the bias. Such means may be a lanyard release ring to which is connected lanyards extending from the rear of the connector.

BRIEF DESCRIPTION OF THE DRAWINGS

An embodiment of the invention will now be described by way of example with reference to the accompanying drawings, in which.

DESCRIPTION OF THE PREFERRED EMBODIMENTS

Figure 1:
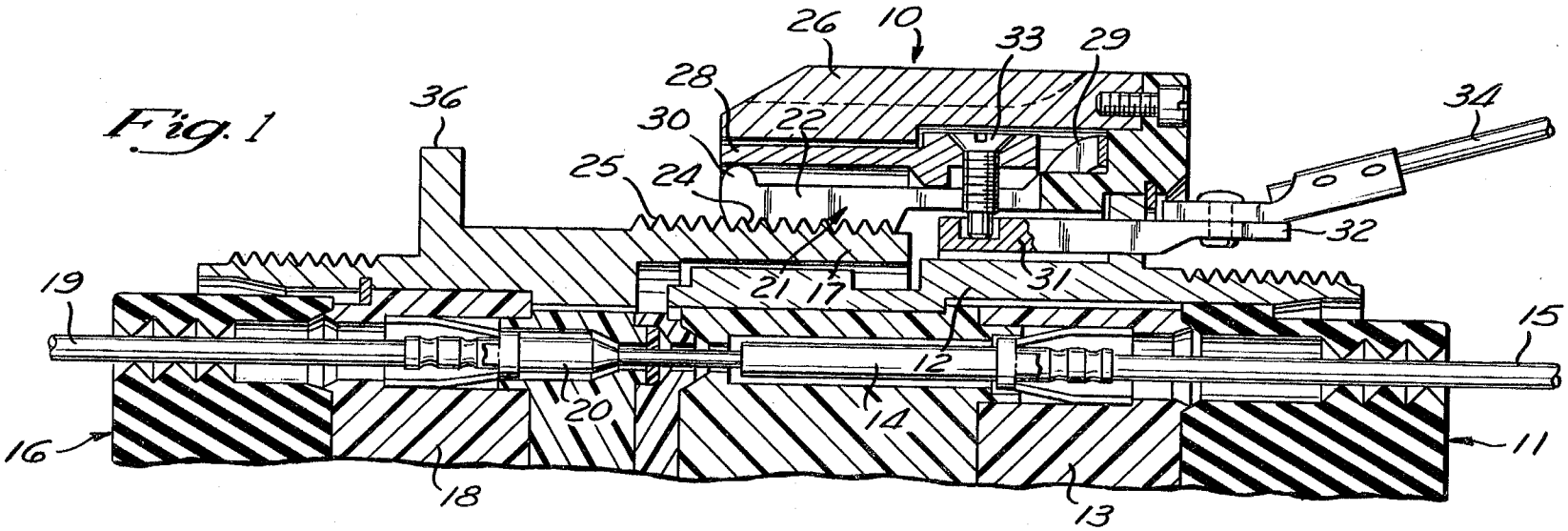
FIG. 1 is a vertical cross-section through a portion of a quick-release electrical connector in accordance with the invention.
Figure 2:
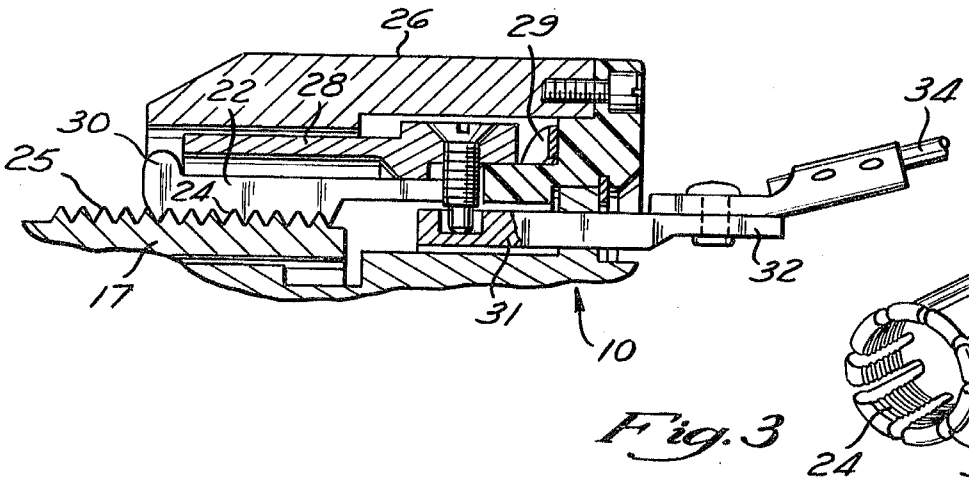
FIG. 2 is a detail similar to FIG. 1 but of the connector at the time of quick release.
Figure 3:
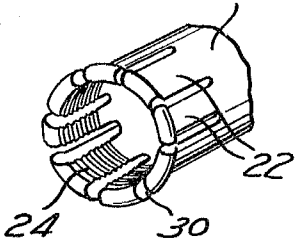
FIG. 3 is a perspective view of a coupling member used in the connector of the previous FIGS.

Referring to FIGS. 1 to 3, the drawings show a two-part quick-release electrical connector assembly 10. The first connector 11 comprises a shell 12 housing a block 13 of insulator material which supports a plurality of socket contacts 14 (only one is shown in FIG. 1). Each socket contact 14 is secured at the end of a respective wire 15 led in through the rear of the block 13. In a similar manner, the second connector 16 comprises a shell 17 housing a block 18 of insulating material through which respective wires are led to plug contacts 20.

A coupling member 21 is captive on, and rotatable about the axis of, the first connector 11 and has circumferentially spaced, forwardly projecting tangs 22 of resilient polymeric material. As can be seen in FIG. 3, these tangs 22 constitute a gapped barrel 23. The barrel 23 has an internal gapped screwthread 24 for engagement with an external screwthread 25 on the second part 16. Both the internal screwthread 24 and the external screwthread 25 are of rounded V-shaped profile. A grooved sleeve 26 housing the coupling member 21 is secured to the rear of the gapped barrel 23 and has a plurality of spaced longitudinal grooves 27 (FIG. 4) to facilitate a manual grip.

Housed within the sleeve 26 is an inhibitor ring 28. This ring is urged forwardly by a wave spring 29 to adopt a position in which it is in encircling engagement with a gapped rib 30 on the forward end of the barrel 23. In this position, shown in FIG. 1, the inhibitor ring 28 inhibits radial outward deflection of the tangs 21. A lanyard release ring 31 is also housed within the sleeve 26 and has two diametrically opposite projections 32 which extend out rearwardly from the part 11. The inhibitor ring 28 is secured to move with the lanyard release ring 31 by screws 33 which pass through the gaps of the gapped barrel 23, and lanyards 34 are riveted to the projections 32.

In use, the first connector 11 is first coupled to the second connector 16 by screwing the coupling member 21 of the first connector on to the external screwthread 25 of the second connector by gripping and rotating the sleeve 26 which houses the coupling member. The connector 10 is then in the position shown in FIG. 1. Merely pulling on the wires 15 which lead into the first part 11 does not result in release of the two parts of the connector assembly, and the two connectors 11 and 16 can be uncoupled by unscrewing the member with the aid of the sleeve 26. However, by pulling on the lanyards 34 the inhibitor ring 28 is moved to its second position shown in FIG. 2 where the tangs 22 are no longer constrained against outward radial deflection.

With the inhibitor ring 28 in its second position, rapid separation of the two connectors is permitted by application of an axial quick-release force sufficient to cause such interaction of the said internal and external screwthreads 24, 25 that the barrel 23 expands by enforced radial outward deflection of the resilient tangs 21 and the internal screwthread 24 rides axially over the external screwthread 25 to effect the separation of the two connectors 11, 16.

Further according to the invention there is provided a two-part, screw-coupled, electrical connector assembly, wherein a normally inoperative ratchet is provided between one of the two parts and on rotatable coupling member on the other of the two parts to become operative only when the connectors approach a fully mated condition by rotation of the coupling members and thereby provides a lock against contra-rotation of the coupling members and an audible indication that the fully mated condition is being approached and wherein means are provided permitting the lock provided by the ratchet to be overridden for disengagement of the two parts of the connector.

Figure 4:
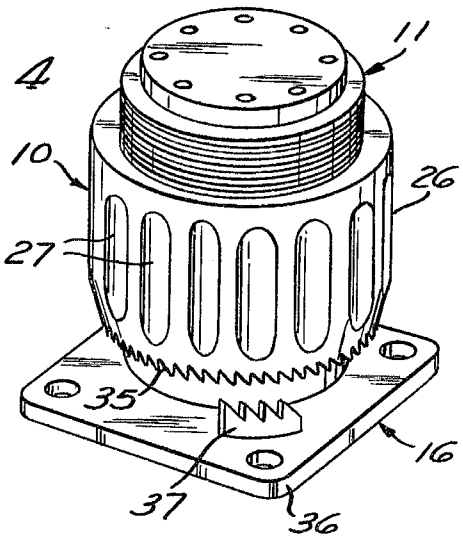
FIG. 4 is a partially cutaway perspective view of a modified form of the connector of FIGS. 1, 2 and 3.

Referring now to FIG. 4 this shows such an arrangement as a modification of the connectors of FIGS. 1 to 3 in which the forward end of the sleeve 26 is extended and provided with a sawtoothed edge 35. A flange 36 on the second connector 16 carries a member 37 of resilient moulded plastics material provided with sawteeth projecting towards and in alignment with the sawteeth 35. The arrangement is made such that when the connector approaches the fully mated condition by rotation of the sleeve 26 inter-engagement of the sawteeth prevents contra-rotation of the sleeve 26 and hence prevents release of the connector by, for example, vibration which could otherwise cause releasing rotation of the sleeve 26. Moreover, at the same time, the clicking action of the inter-engaging sawteeth produces an audible noise indicative of the fact that the fully mated condition is being approached.

It will be appreciated that the arrangement of the teeth 35 and the teeth on the member 37 constitutes a normally inoperative ratchet. It is not until the two connectors approach the fully mated condition that the ratchet becomes operative to prevent contra-rotation of the coupling ring or sleeve 26. At the same time audible clicking occurs by the interaction of the teeth.

For disengagement of the two connectors, the locking action provided by the ratchet is overridden by the application of a quick-release force on the lanyard 34 whereby disengagement takes place as previously described with reference to FIGS. 1, 2, 3.

From the foregoing, it can be readily realized that this invention can assume various embodiments. Thus, it is to be understood that the invention is not limited to the specific embodiments described herein, but is to be limited only by the appended claims.

The embodiments of the invention in which an exclusive property or privilege is claimed are defined as follows:

1. A two-part screw-coupling electrical connector comprising a normally inoperative ratchet means engageable between one of the two parts and a rotatable coupling member on the other of the two parts to become operative only when the connector approaches a fully mated condition by rotation of the coupling member in a mating direction and an audible indication that the fully mated condition is being approached, said ratchet means providing a lock against contra-rotation of the coupling member in an unmating direction, and wherein means are provided permitting the locking action provided by the ratchet means to be overridden by disengagement of the two parts of the connector in an axial direction.

2. A connector according to claim 1, wherein the ratchet comprises forwardly directed, circumferentially-spaced ratchet teeth on said rotatable coupling member and at least one cooperating ratchet tooth on said one part.

3. A connector according to claim 2, wherein said tooth is of resilient material.

4. A connector according to claim 1, wherein the means to override the ratchet lock comprises circumferentially-spaced forwardly-projecting tangs of resilient material on said rotatable coupling member, constituting a gapped barrel on which an internal correspondingly gapped screw-thread is formed for engagement with an external thread on a member of said one part and permitting disengagement of the two parts of the connector by an axial release force sufficient to cause such interaction of said internal and external screw-threads that the barrel expands by enforced radially-outward deflection of the resilient tangs and the internal screwthread rides axially over the external screwthread.

5. A connector according to claim 4, wherein inhibitor means is provided which is axially movable between a first position in which inhibits said expansion is inhibited and a second position in which said expansion is permitted.

* * * * *